United States Patent [19]

Vanvlaenderen

[11] 4,209,153

[45] Jun. 24, 1980

[54] FUNCTIONAL MESH OR NETTING

[75] Inventor: Roger Vanvlaenderen, Zwevegem, Belgium

[73] Assignee: N. V. Bekaert S. A., Zwevegem, Belgium

[21] Appl. No.: 19,234

[22] Filed: Mar. 9, 1979

Related U.S. Application Data

[63] Continuation of Ser. No. 806,442, Jun. 14, 1977.

[51] Int. Cl.[2] ..... B21F 27/00

[52] U.S. Cl. ..... 245/8; 256/45

[58] Field of Search ..... 256/45; 245/5, 2, 8

[56] References Cited

U.S. PATENT DOCUMENTS

| | | | |
|---|---|---|---|
| D. 33,509 | 11/1900 | Ward | 256/45 UX |
| 483,186 | 9/1892 | Trick | 256/45 |
| 541,487 | 6/1895 | Little | 256/45 |
| 625,661 | 5/1899 | Ellheridge | 256/45 X |
| 769,180 | 9/1904 | Parrist | 256/45 UX |
| 1,378,489 | 5/1921 | Sommer | 256/45 X |
| 2,148,380 | 2/1939 | Schueler | 256/45 |
| 3,578,036 | 5/1971 | Francois et al. | 140/112 X |

*Primary Examiner*—Leon Gilden

*Attorney, Agent, or Firm*—Edward J. Brenner

[57] ABSTRACT

A mesh or netting useful for fencing animals comprising a plurality of longitudinal wires mutually connected together in the vertical direction by weft wires, wherein the longitudinal wires as a function of their positions in the vertical direction of the mesh or netting have different strengths. The wires may be arranged in groups wherein the wires strengths vary from group to group. The differences in wire strengths may be obtained by wires having different thicknesses, iron or steel wires of different carbon contents, wires made of different materials or wires having different numbers of elementary wires.

11 Claims, 3 Drawing Figures

FUNCTIONAL MESH OR NETTING

CROSS-REFERENCE TO RELATED APPLICATION

The present application is a continuation of Ser. No. 806,442 filed June 14, 1977, now on appeal.

BACKGROUND OF THE INVENTION

The invention relates to a mesh or netting comprising a number of longitudinal wires, which, in the vertical direction, are mutually connected by vertical weft wires. A mesh or netting of this type is widely used for fencing areas or grounds in which animals are to be isolated. Such animals may be chickens, rabbits, hare, sheep, pigs, deer, and the like. In certain cases different kinds of animals are to be separated from each other, and in other cases, the fence must be suited to keep a combination of different species inside the field. To that end there are a number of standard mesh or netting types, offering a variety of different heights, wire spacings and strengths.

Normally, all longitudinal wires of a fence are made of the same material, generally ferrous or steel wire, but also aluminum or copper are used. Usually, these materials are provided with a coating, such as zinc or plastic. The diameter or thickness of the longitudinal wires made of a material with a given tensile strength is governed by the magnitude of the forces that may possibly be exerted by the strongest animals that one wants to keep inside the field. The spacing between the longitudinal wires on the other hand is determined by the size of the smallest animals that must be retained. The result of these considerations is that the fences made to date are nearly always too strong at least over a part of the height.

Thus, for example, a type of known fence has spacings between the longitudinal wires which increase in the upward direction. More particularly, the five lowermost longitudinal wires may have a common spacing of say 5 cm., thereabove there is a group of 5 to 10 wires with a common spacing of 10 cm., and thereabove again 3 to 4 wires with a common spacing of 15 cm., possibly followed by some wires at a still higher level with a common spacing of 20 cm. Such fencings are used in wooded grounds. The wire strength, wich in practice generally correspond to the wire thickness, is then determined by the requirement that deer and other big game must be retained. Such big game, however, apply their forces exclusively on the upper half of the fence height. The result is that the strength in the lower part of the fence height is greater than necessary. Further, this drawback is made even worse due to the requirement that the spacings in the downward direction must be smaller to retain smaller animals, such as hare, so that on an average there are more wires per unit of height.

SUMMARY OF THE INVENTION

It is a feature of the mesh or netting of the present invention that as a function of their position in the vertical direction of the mesh or netting, the longitudinal wires have different strengths. In accordance with this principle, it is possible to provide an entirely functional fence for various applications, which in all cases saves considerable material since any oversizing is avoided.

It is to be also noted that a mesh or netting is known wherein the vertical wires are not continuous from top to bottom and fixed to the crossing longitudinal wires by knots or welds, but instead the vertical wires consist of separate pieces that are provided between two successive longitudinal wires. The concept of the present invention can be also desirably applied to this type of fence to thereby provide that the separate vertical pieces have different strengths depending upon their position in the vertical direction of the mesh or netting.

There are several possibilities for providing different wire strengths. When all wires are made of the same material, then the simplest approach is to use wires of different thickness. Another solution is to use wires that are made of iron or steel with different carbon contents so that different strengths are obtained for the same diameter.

A further variant with interesting possible applications involves changing the wire material as a function of the height. Finally the basic concept of the invention can be achieved in a most simple and advantageous way by the application of wires that are partially composed of single wires, and on the other hand, multiple elementary wires that are located at a short distance from each other. Thus, for example, a double wire gives double strength, a threefold wire a threefold strength, and so forth. An important advantage of this embodiment is that during the manufacture of the mesh, at the point where the longitudinal wires are welded to the vertical wires, any difficulties of controlling the welding operations at the different welds due to changing material properties or changing thicknesses are avoided.

The variation in wire strength does not need to be continuous. A preferred embodiment of the present invention involves the use of groups of neighboring wires of substantially the same strength and wherein there are different common strengths between the groups. This embodiment is somewhat similar to the aforementioned fence type wherein the longitudinal wires are arranged in groups having different mutual spacings.

It is advantageous in many applications to provide the strength of the wires in the respective wire groups rises in the upward direction. Indeed, it will often occur that the biggest animals will require the greatest strengths at the highest levels.

However, in another important variant the strengths of the wires in the respective wire groups decrease in the upward direction. Such fences are, for example, well suited for pigs which tend to exert the greatest forces near the ground.

It is also to be noted that it is conventional procedure to provide the uppermost and lowermost longitudinal wires, or some of the lowermost or uppermost longitudinal wires, with a diameter exceeding that of the other longitudinal wires. These reinforcements at the upper and underside of the fence are called selvedges which facilitate the tensioning of the fence during installation. Obviously, the application of selvedges does not fall within the scope of this invention, but on the contrary they can be applied in combination with it.

BRIEF DESCRIPTION OF THE DRAWINGS

The invention will be best understood by reference to the drawing in which.

DESCRIPTION OF THE PREFERRED EMBODIMENTS

Figure 1:
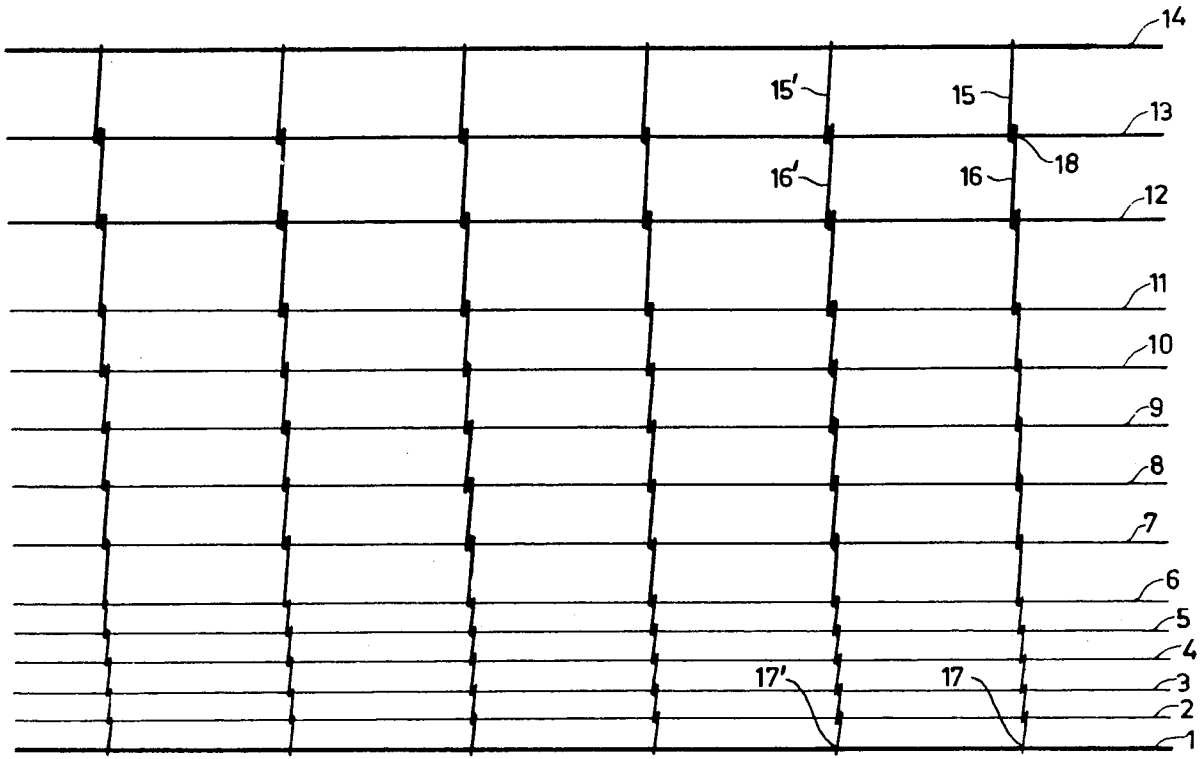
FIG. 1 is a schematic view of a portion of a netting constructed according to the present invention.

FIG. 1 shows a piece of netting of a generally known type with respect to wire spacings which is to be used as a fence. It comprises a number of mutually parallel longitudinal wires 1 through 14, which are made in long lengths and are disposed in parallel relationship and at a definite distance from each other by vertical wires, such as 15, 16, 17 and 15', 16', and 17', which run in the vertical direction and at right angles to the longitudinal wires.

A feature of this general type of fence that is here shown by way of example is that the longitudinal wires are disposed at mutually different distances. The mutual spacings between the neighboring wires in the groups 1 through 6 are constant and the smallest; in a practical case, these lowermost wires may have a mutual spacing of 5 cm. Then follows the group of wires 7 through 11. The distance between the longitudinal wire 7 and the longitudinal wire 6 as well as the mutual or common distances between the other wires in this group are constant, but greater; in a practical case, the mutual wire spacing may here be 10 cm. Then follows a third group of longitudinal wires 12 through 14, which mutually and in respect of wire 11 have a still greater spacing, say 15 cm. (There are also standard embodiments of this type wherein at the upperside a number of longitudinal wires are added with mutual spacings of say 20 cm.)

In this general type of fencing one can see an application of two principles that lie at the basis of the dimensioning of the fencing mesh or netting, viz., at the top of the fence there must be sufficient strength to retain the bigger animals, so that the mutual distance between the longitudinal wires may remain relatively great as big animals cannot pass through by their own means, whereas the mutual distance between the wires further down must be smaller to prevent the smaller animals from passing through the wires.

The spacings between the longitudinal wires are determined and maintained by the wefts. Any weft between the uppermost longitudinal wire and the lowermost longitudinal wire may consist of a single piece of wire, but there also is a practical variant whereby the weft is composed of a number of separate pieces, such as 15, 16 and 17, which maintain the desired distance between the two neighboring longitudinal wires. There are two ways to connect the longitudinal wires to the vertical weft wires. In the case of weld connections, the product is called mesh and when knots or bends are applied at the crossings the product is called a netting. FIG. 1 shows a case where at the crossings, such as 18, a double knot connection is made between, respectively, the underend of the vertical wire piece 15 and the upper end of the vertical wire piece 16, with the longitudinal wire 13 in between.

FIG. 1 shows that the lowermost longitudinal wire 1 and the uppermost longitudinal wire 14 are made of heavy (thick) wire. Both of these extreme wires are called selvedges. The function of the thickness and respective strength of these wires has nothing to do with the resistance against the forces exerted by animals, but only with the necessity to stretch the fence as a whole tightly between the posts.

So far the description of the design of the fence has been known. In such a conventional design, the fence is made of equally thick longitudinal wires and equally thick vertical wires, either of the same size or not as the longitudinal wires. The analysis of the strength properties of such conventional netting is illustrated by means of FIG. 2. This rather idealized graph illustrates for different situations the relation between the average strength of the mesh or netting and its location in vertical direction. To facilitate the understanding of this graph, reference is made first to the broken horizontal line A. This line is applicable to a mesh or netting which has all of its wires, i.e., at any height, of the same strength. This relation holds for a mesh or netting composed of identical wires with equal or common spacings. Broken line B gives the relation between the average strength and the height of the fence of the type shown in FIG. 1, this fence being composed of longitudinal wires with identical properties, but with the described variation of mutual spacings. At the upperside of the fence, this is at the right end of the curve b, the material has a certain mean strength, as calculated per unit of length in the vertical direction. The strength represents the force that can be exerted on some longitudinal wires in lengthwise direction before fracture occurs. Because, in a fence of the general type shown in FIG. 1, the number of wires per unit of length in the vertical direction increases in the direction of the position of the fence closer to the ground, the mean strength value will rise. Roughly it can be said that when the longitudinal wires 1 through 6 have a mutual spacing of 5 cm., and the wires 12 to 14 a mutual spacing of 15 cm., the average strength at the bottom is three times as high as at the top. When the strength at the upperside of the fence is calculated with respect to the forces that can be exerted by large animals, this shows that in the lower part of the fence there is not only a threefold overdimensioning, but even a greater multiple thereof, because the lower portion of the fence must only be able to withstand the forces exerted by small animals, which clearly are much lower.

In light of this analysis, the present invention contemplates the concept of using longitudinal wires of different strengths. For the fence of the type shown in FIG. 1, this means that the pattern of the mutual or common spacings between the longitudinal wires 1 through 14 is maintained, but that toward the bottom the wires have less strength.

The present concept can be thus realized by using longitudinal wires wherein there is a small mutual difference in strength (for example thickness) between each of the wires. In practice, however, it is simpler to use a design wherein the strength properties are groupwisely changed, more particularly, such that the groups of wires with equal strength properties correspond to the groups of wires having equal mutual spacings. This concept is illustrated in FIG. 1. More particularly, it is to be noted that the wires 2 through 6, with a mutual spacing of 5 cm., are drawn thinnest, that the wires 7 through 11 with a mutual spacing of 10 cm. are slightly heavier, and that the wires 12 and 13 with a mutual spacing of 15 cm. are still heavier and therefore drawn in thicker lines in the figure.

Figure 2:
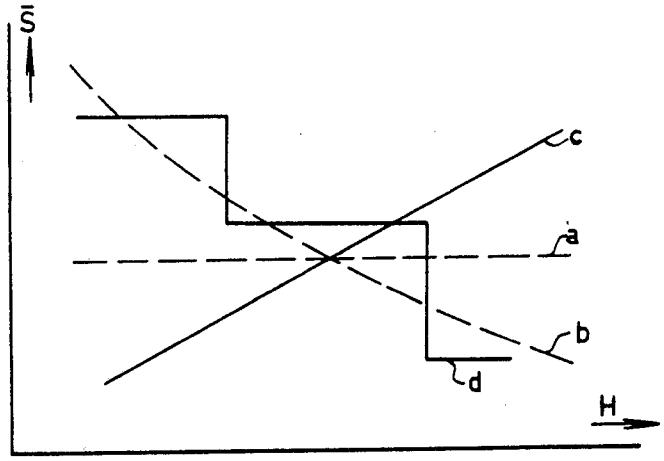
FIGS. 2 and 3 are graphs illustrating some of the basic principles of the present invention.
Figure 3:
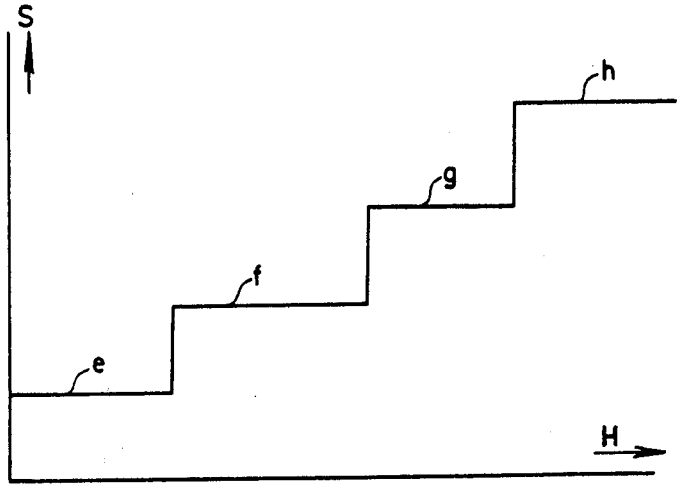

With the same somewhat general representation, a fence is formed having the characteristics shown by line c in FIG. 2. This means that the strength at a low height is relatively small but increases accordingly as the fence gets higher. This is illustrated in still greater detail in FIG. 3 where the strength of the separate wires is plotted versus their position in the vertical direction of the fence. Thus, at low height the weakest wires are indicated by e, the next wire group which is located somewhat higher with a higher wire strength is indicated by f, and the next group of wires with a strength still higher is indicated by g. In FIG. 3, a group of still stronger wires is shown at h for a case where it is desired to extend the mesh type of fence shown in FIG. 1 with a number of wires having a mutual spacing of say 20 cm.

Thus, the present invention involves the basic concept of using longitudinal wires having a changing strength as a function of the height, the particular design depending upon the requirements of each practical application case. Another specific embodiment, which will serve as an illustration of this concept, is a fencing designed for retaining pigs. Pigs do not tend to climb a fence, but rather to exert forces with their snouts at a short distance from the ground. In this case, it will suffice to use relatively weak wires in the upper part, whereas longitudinal wires with a greater strength are used in the lower places, such as for example shown as by line d in FIG. 2.

The present inventive concept may further be utilized in a design in which the weft wire pieces such as wires 15, 15', 16, 16' . . . 17, 17' have different strength properties. This would not generally be utilized in cases where the weft consists of a single continuous wire over the entire height between the selvedges 1 and 14, but it is particularly applicable in cases where the weft consists of separate pieces. Since it is customary practice in production to use as many wire spools as the number of weft wire pieces that are to be made in this manner, all these pieces can be brought together simultaneously. It is also possible to provide in the different locations, spools of wire having different material properties for the longitudinal wires 1 through 14.

In general, the present inventive concept contemplates basically that wire having different strength properties will be utilized. These different strengths may be obtained in various ways. A number of ways are particularly advantageous.

First of all, wire of the same material but with different thickness (diameters) can be used. However, when, for example, because of welding problems or similar manufacturing considerations, it is preferred to use wire with the same diameter throughout, the strength properties can be varied by using material having other properties. This may be achieved in two ways, namely, by using iron or steel wire having different carbon contents (it being known that the tensile strength of steel products increases with increasing carbon content), or by using entirely different materials, for example, steel, iron, and light metal, such as aluminum. Another embodiment is to have each longitudinal wire, as shown in FIG. 1 composed of 1, 2 and 3 or more elementary thin wires, which in production are placed so closely against each other or at such a short distance from each other, that in practice one may speak of them as being one single longitudinal wire. The disadvantage, however, of this variant for obtaining different strengths at different heights is that one must comply with the ratio 1:2:3:4, etc., when material with the same properties is employed. There is an advantage, however, where welds are utilized, because, irrespective of the strength, longitudinal wires having the same thickness are used throughout.

It is also to be understood that the present invention covers any combination of the above-mentioned possibilities to provide the necessary variations of wire strength properties.

I claim:

1. A mesh or netting useful for fencing animals comprising a number of individual longitudinal wires of different strengths, other than selvedges, said individual wires in the vertical direction being mutually connected by weft wires and disposed at different spacings as a function of their position in the vertical direction of the mesh or netting.

2. A mesh or netting according to claim 1 wherein the wefts comprise separate pieces each disposed between two successive longitudinal wires and wherein the separate pieces of the wefts as a function of their position in the vertical direction of the mesh or netting have different strengths.

3. A mesh or netting according to claim 1 wherein said individual longitudinal wires have different thickness.

4. A mesh or netting according to claim 1 wherein the longitudinal wires are made of iron or steel of different carbon contents.

5. A mesh or netting according to claim 1 wherein the longitudinal wires are made of different materials.

6. A mesh or netting according to claim 1 wherein at least some of the longitudinal wires comprise multiple elementary wires.

7. A mesh or netting according to claim 1 comprising groups of neighboring wires wherein the strengths of the wires in one group are substantially the same and those between the groups are different.

8. A mesh or netting according to claim 7 wherein the strengths of the wires in the respective groups of wires rise in the upward direction.

9. A mesh or netting according to claim 7 wherein the strengths of the wires in the respective groups of wire decrease in the upward direction.

10. A mesh or netting according to claim 1 wherein the spacings between the longitudinal wires increase gradually or in groups in the upward direction.

11. A mesh or netting according to claim 1 comprising groups of neighboring wires wherein the strengths and spacings of the wires in one group are substantially the same and those between groups are different.

* * * * *